United States Patent [19]

Kozub

[11] Patent Number: 4,491,323

[45] Date of Patent: Jan. 1, 1985

[54] PENDULUM PUTTER

[76] Inventor: Stanley S. Kozub, 6559 W. Maple Ave., Geneva, Ohio 44041

[21] Appl. No.: 586,132

[22] Filed: Mar. 5, 1984

[51] Int. Cl.[3] ..... A63B 53/14

[52] U.S. Cl. ..... 273/81 D; 273/81.4

[58] Field of Search ..... 273/81 R, 81 D, 81.3, 273/81.4

[56] References Cited

U.S. PATENT DOCUMENTS

| | | | |
|---|---|---|---|
| 2,092,839 | 9/1937 | Gouverneur | 273/81.4 |
| 2,801,106 | 7/1957 | Koehler | 273/81.3 |
| 2,873,970 | 2/1959 | Murphey, Jr. | 273/81.4 X |
| 2,938,728 | 5/1960 | Green | 273/81 D X |
| 3,089,525 | 5/1963 | Palmer | 273/81 R X |
| 3,170,690 | 2/1965 | Goranson et al. | 273/81.3 X |
| 3,245,686 | 4/1966 | Hartmeister | 273/81.3 |
| 3,459,426 | 8/1969 | Sherwood | 273/81 R |

FOREIGN PATENT DOCUMENTS

| | | | |
|---|---|---|---|
| 13480 | of 1907 | United Kingdom | 273/81.3 |

*Primary Examiner*—William H. Grieb
*Attorney, Agent, or Firm*—Harvey B. Jacobson

[57] ABSTRACT

An elongated upstanding shank is provided having upper and lower ends. A golf club putter head is carried by the lower end and the upper end includes a disc-shaped terminal end having its center axis generally horizontally disposed and normal to the longitudinal center axis of the shank. The disc-shaped terminal end includes opposite axial end faces facing in opposite directions disposed at generally right angles relative to the center axis of the shank and the end faces define aligned oppositely facing central areas thereof to be guidingly clamped between the thumb and an opposing finger area of one hand of a golfer preparing to perform a putting stroke and gripping a lower portion of the upper end of the shank with his other hand. The central areas of the axial ends of the disc-shaped terminal end define bearing areas about which the shank is swingable. In a first form of the invention, the central areas of the axial ends of the disc-shaped terminal end are outwardly concave and centrally apertured and in a second form of the invention, the oppositely facing axial end faces of the disc-shaped terminal end are rotatably mounted for angular displacement relative to the remainder of the terminal end about the center axis thereof.

9 Claims, 8 Drawing Figures

PENDULUM PUTTER

BACKGROUND OF THE INVENTION

Various different forms of putters heretofore have been designed in order to increase the accuracy of the putting stroke of a golfer. Some of these different forms of putters have been constructed to function in the manner of a pendulum while other have included grip structure different from a conventional putter but not functional in the manner of a pendulum.

Examples of various different forms of putters are disclosed in U.S. Pat. Nos. 2,092,839, 2,938,728, 3,089,525, 3,170,690, 3,245,686 and 3,459,426.

The first, second, fourth and fifth mentioned patents disclose golf clubs which perform at least to some degree in the manner of a pendulum, but the pendulum action of each is somewhat difficult to control for various reasons.

Accordingly, a need exists for a pendulum-type putter whose structural and operational features may be used by substantially all golfers in order to improve upon their putting stroke.

BRIEF DESCRIPTION OF THE INVENTION

The putter of the instant invention includes a shank upper terminal end which is in the form of a disc-shaped end portion including oppositely horizontally facing axial surfaces adapted to be gripped by the thumb and an opposing finger of the upper hand of a golfer. In a first form of the invention, the oppositely facing surfaces, which are coaxial, are concave and centrally apertured for seated engagement of the thumb and an opposing finger of a golfer's hand to grip the upper end of the shank and in a second disclosed form of the invention, the opposite axial end faces are defined by disc members which are rotatably supported from the shank upper end for angular displacement about an axis normal to the axial end faces.

The main object of this invention is to provide an improved golf putter which may be used in the manner of a pendulum and including a simplified upper end grip portion designed to function as the axis of swinging movement of the putter and readily engageable between the thumb and an opposing finger of a golfer's hand.

Another object of this invention is to provide an upper end grip for a putter to be gripped between the thumb and opposing finger of one hand of an associated golfer and including structure by which the axis of swinging movement of the putter in a pendulum fashion will be defined by the areas of the putter engaged between the thumb and an opposing finger.

Still another important object of this invention is to provide a pendulum putter which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
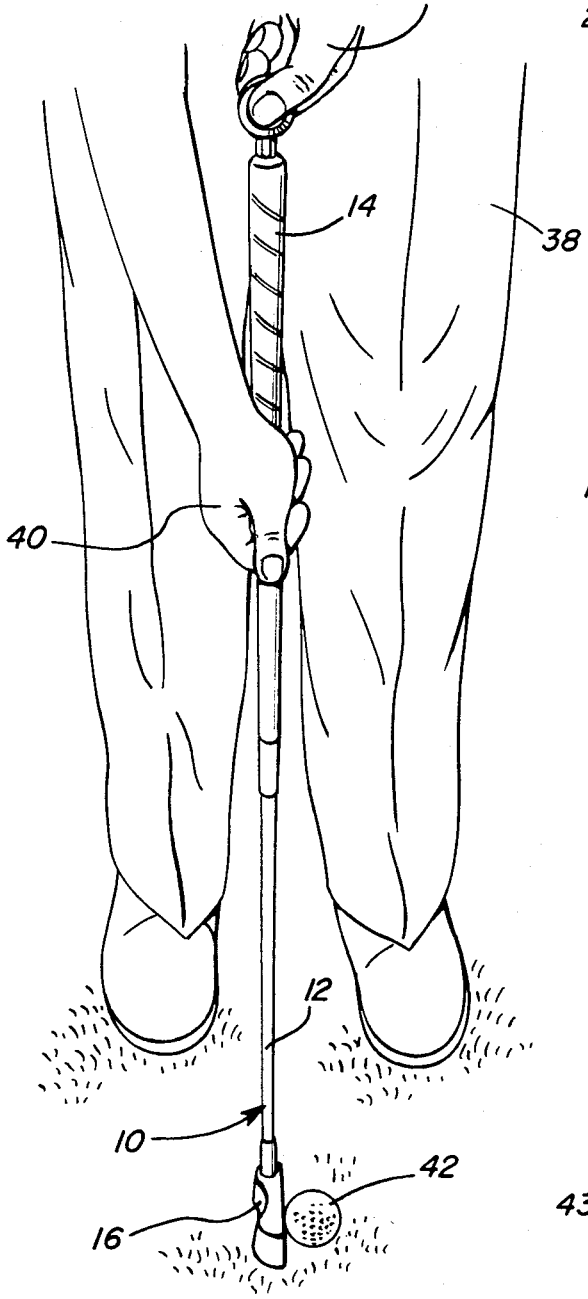
FIG. 1 is a perspective view of a pendulum putter constructed in accordance with the present invention.
Figure 2:
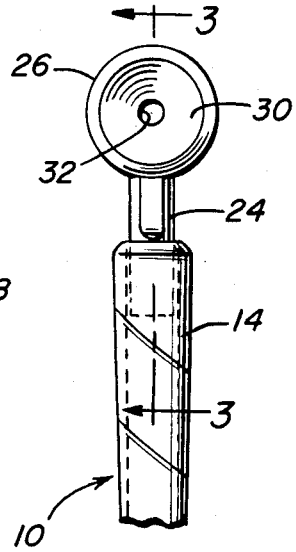
FIG. 2 is an enlarged fragmentary front elevational view of the upper shank end of the putter.
Figure 3:
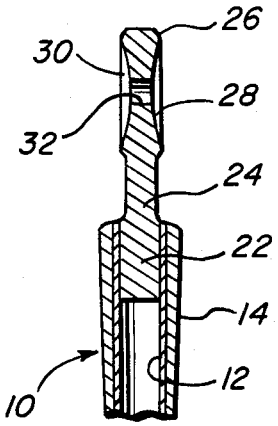
FIG. 3 is a fragmentary vertical sectional view taken substantially upon the plane indicated by the section line 3—3 of FIG. 2.
Figure 4:
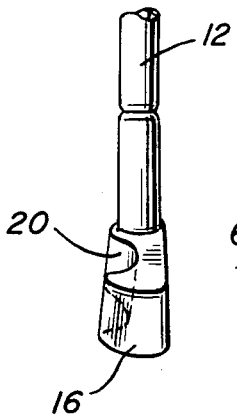
FIG. 4 is a front perspective view of the lower end of the putter.
Figure 5:
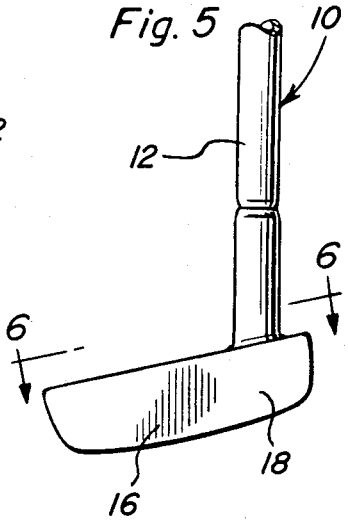
FIG. 5 is a fragmentary side elevational view of the putter lower end as seen from the right side of FIG. 4.
Figure 6:
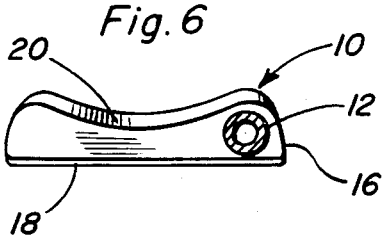
FIG. 6 is a fragmentary horizontal sectional view taken substantially upon a plane indicated by the section line 6—6 of FIG. 5.

Referring now more specifically to the drawings, the numeral 10 generally designates a putter including an upright shank 12 which is downwardly tapered and is tubular in configuration. The upper end of the shank includes the usual wrapped handgrip 14 and the lower end of the shank has a putter head 16 mounted thereon.

The putter head 16 is elongated and projects outwardly from one side of the lower end of the shank 12 and defines an included angle therewith of generally 105°. The front side of the head 16 includes a planar ball striking face 18 disposed at a lift angle of between 2° and 5° and the rear side of the head 16 includes a vertically extending partial semi-cylindrical recess 20 with the central portion of the recess disposed in front-to-rear alignment with the central area of the ball striking face 18.

The upper end of the shank 12 has the lower shank end 22 of an upper terminal end section 24 stationarily secured therein in any convenient manner and the terminal end section 24 defines an upper disc-shaped terminal end 26 including oppositely facing axial end surfaces or faces 28 and 30. A horizontal transverse bore 32 is formed axially through the disc-shaped terminal end 26 along the center axis thereof and the opposite ends of the bore 32 open centrally outwardly through the faces 28 and 30. The faces 28 and 30 are concave partial spherical and the radius of curvature of the face 28 is greater than the radius of curvature of the face 30. Therefore, the recess defined by the concavity of the face 30 is deeper than the recess defined by the concavity of face 28.

It will be noted that the longitudinal center axis of the disc-shaped terminal end 26 is disposed in a vertical plane containing the shank 12 and disposed normal to a vertical plane containing the shank 12 and the head 16. Further, the recess defined by the face 30 faces in generally the same horizontal direction in which the major length portion of the head 16 projects outwardly from the lower end of the shank 12.

In operation, the terminal end 26 is gripped between the thumb and an opposing finger portion of one hand 36 of a person 38 wishing to perform a putting stroke while the other hand 40 of the person 38 grips the lower portion of the handgrip 14 in the conventional manner.

While the hand 36 is held stationary, the hand 40 is used to swing the shank 12 in pendulum fashion about an axis of angular displacement coinciding with the longitudinal center axis of the bore 32 in order to strike an associated golf ball 42 with the head 16 of the putter 10. The recesses defined by the concavities 28 and 30 and the central bore 32 serve to maintain the axis of angular displacement of the shank 12 stationary relative to the hand 36. Thus, the golfer 38 need only be sure that his hand 36 is held stationary while his hand 40 causes the shank 12 to swing relative to his hand 36 in pendulum fashion when striking the ball 42 toward the cup.

Figure 7:
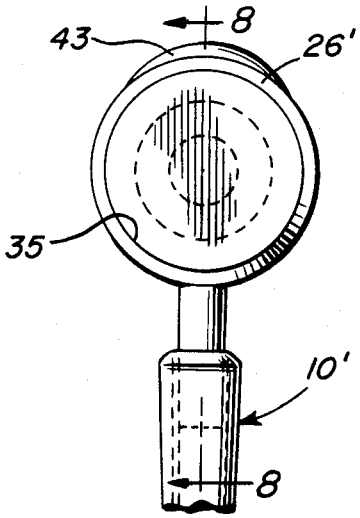
FIG. 7 is a enlarged front elevational view of the upper end of the putter illustrating a modified form of the invention.
Figure 8:
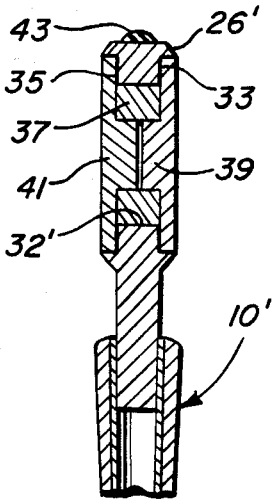
FIG. 8 is a fragmentary vertical sectional view taken substantially upon a plane indicated by the section line 8—8 of FIG. 7.

With attention now invited more specifically to FIGS. 7 and 8 of the drawings, there may be seen a modified form of putter referred to in general by the reference numeral 10'. The putter 10' includes a disc-shaped terminal end 26' corresponding to the terminal end 26 and having a bore 32' formed centrally therethrough including opposite end counterbores 33 and 35. A sleeve bearing 37 is rotatably received in the bore 32' and may be slightly greater in axial extent than the bore 32'. A pair of opposite end disc members 39 and 41 may be secured to opposite axial ends of the sleeve bearing 37 and thus rotatably supported from the terminal end 26'. The disc members 39 and 41 are received in the counterbores 33 and 35, respectively, and are thus rotatable relative to the terminal end 26' about the center axis of the bore 32'. The remote axial faces of the disc members 39 and 41 are planar for engagement by the thumb and an opposing finger of the hand 36, but these planar faces may also be dished in the same manner in which the faces 28 and 30 are dished. Further, the disc members 39 and 41 could include central bores formed therethrough.

The putter 10' is used in the same manner as the putter 10, except that the disc members 39 and 41 need not rotate relative to the thumb and opposing finger of the hand 36. Further, the uppermost extremity of the terminal end 26' includes an arcuate resilient bumper 43 supported therefrom in order to protect the terminal end 26'. The lower shank end 22 of the upper terminal end shank 24 may be secured in any convenient manner within the interior of the upper end of the shank 12. Of course, the terminal end 26' may also have its corresponding shank anchored within the upper end of the tubular shank of the putter 10' in a similar manner.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pendulum putter including an elongated upstanding shank having upper and lower ends, a golf club putter head carried by said lower end, said upper end including a disc-shaped terminal end disposed with its center axis generally normal to the longitudinal center axis of said shank and including opposite axial end faces facing in opposite directions disposed at generally right angles relative to said center axis, said putter head comprising an elongated generally horizontal head member with a major portion of the length thereof projecting endwise outwardly of one side of said shank, one of said end faces facing outwardly of said one side of said shank, said end faces defining central areas thereof adapted to be guidingly clamped between the thumb and an opposing finger area of one hand of a golfer preparing to perform a putting stroke and gripping a lower portion of the upper end of the shank with his other hand, said central area defining bearing areas engaged by said thumb and finger area about which said lower end and head are swingable.

2. The putter of claim 1 wherein said end faces are stationarily supported relative to said terminal end.

3. The putter of claim 2 wherein said end faces are outwardly partially spherical concave.

4. The putter of claim 2 wherein said terminal end includes a horizontal transverse bore formed therethrough, the opposite ends of said bore opening centrally through said end faces.

5. The putter of claim 4 wherein said end faces are outwardly partially spherical concave.

6. The putter of claim 1 wherein said end faces are defined by oppositely facing disc-members rotatably supported from said terminal end for angular displacement about the center axis of said disc-shaped terminal end.

7. The putter of claim 6 wherein said end faces are substantially planar.

8. The putter of claim 1 wherein said end faces are stationarily supported relative to said terminal end, said concave end faces defining thumb and opposing finger portion receiving recesses, the recess defined by said one face being deeper than the other recess.

9. The putter of claim 1 wherein one longitudinal side surface of said head is substantially planar and inclined between 2° and 5° relative to a vertical plane containing said shank and said head.

* * * * *